US009688042B2

(12) United States Patent
Frank

(10) Patent No.: US 9,688,042 B2
(45) Date of Patent: Jun. 27, 2017

(54) FORMAT ADJUSTMENT DEVICE

(75) Inventor: Alexander Frank, Schaffhausen (CH)

(73) Assignee: Robert Bosch GmbH, Stuttgart (DE)

( * ) Notice: Subject to any disclaimer, the term of this patent is extended or adjusted under 35 U.S.C. 154(b) by 759 days.

(21) Appl. No.: 14/111,784

(22) PCT Filed: Mar. 30, 2012

(86) PCT No.: PCT/EP2012/055863

§ 371 (c)(1),
(2), (4) Date: Oct. 15, 2013

(87) PCT Pub. No.: WO2012/139907

PCT Pub. Date: Oct. 18, 2012

(65) Prior Publication Data

US 2014/0228191 A1 Aug. 14, 2014

(30) Foreign Application Priority Data

Apr. 15, 2011 (DE) ..... 10 2011 007 488

(51) Int. Cl.
*B31B 3/26* (2006.01)
*B31B 49/02* (2006.01)
(Continued)

(52) U.S. Cl.
CPC ..... *B31B 3/26* (2013.01); *B31B 49/02* (2013.01); *B65B 43/10* (2013.01); *B65B 59/00* (2013.01); *B65B 2220/02* (2013.01)

(58) Field of Classification Search
CPC ..... B65B 59/00; B65B 59/04; B31B 1/46
(Continued)

(56) References Cited

U.S. PATENT DOCUMENTS 3,631,769 A * 1/1972 Hammerle ..... B65B 43/10 493/424
3,665,675 A * 5/1972 Johnson ..... B65B 43/265 53/223

(Continued)

FOREIGN PATENT DOCUMENTS

DE 1561444 4/1970
DE 8420744 8/1987

(Continued)

OTHER PUBLICATIONS

International Search Report for Application No. PCT/EP2012/055863 dated Jul. 19, 2012 (2 pages).

*Primary Examiner* — Thanh Truong
*Assistant Examiner* — Patrick Fry
(74) *Attorney, Agent, or Firm* — Michael Best & Friedrich LLP

(57) ABSTRACT

A format adjustment device (1) is used to adjust the format of at least one functional element (7) on a packaging machine. The format adjustment device (1) comprises at least one bearing element (2), at least one format gauge (3) comprising at least one mounting section (4) and at least one position element (5) having a stop section (6), and at least one functional element (7) having a connecting section (8). The format gauge (3) can be connected to the bearing element (2) via the mounting section (4). The stop section (6) of the position element (5) can be connected to the connecting section (8) of the functional element (7), such that the position of the at least one functional element (7) relative to the bearing element (2) can be adjusted.

24 Claims, 12 Drawing Sheets

(51) Int. Cl.
*B65B 43/10* (2006.01)
*B65B 59/00* (2006.01)

(58) Field of Classification Search
USPC ..... 493/478
See application file for complete search history.

(56) References Cited

U.S. PATENT DOCUMENTS 3,800,681 A * 4/1974 Corderoy ..... B31B 19/00 493/151
4,197,789 A * 4/1980 Moen ..... B31B 1/00 493/167
4,674,998 A * 6/1987 Benedicenti ..... B31B 1/00 493/124
4,988,331 A * 1/1991 Boisseau ..... B31B 1/00 493/143
5,360,099 A 11/1994 Culpepper et al.
5,382,155 A * 1/1995 Boix Jaen ..... B31B 1/00 249/158
5,454,206 A * 10/1995 Bailer ..... B65B 59/00 53/157
5,689,932 A * 11/1997 Peronek ..... B65B 43/60 53/201
5,732,528 A * 3/1998 Peronek ..... B65B 43/60 53/201
7,509,789 B2 * 3/2009 Scholtes ..... B31B 1/00 493/163
7,658,054 B2 * 2/2010 Veix ..... B65B 43/265 53/381.1
8,024,910 B2 * 9/2011 Graham ..... B31B 1/00 493/70
2007/0245689 A1 10/2007 Lubezny

FOREIGN PATENT DOCUMENTS

DE 19618373 5/1997
DE 102005026455 1/2006
EP 215742 3/1987
EP 1400453 3/2004
GB 420378 11/1934
GB 1536173 12/1978

* cited by examiner

FORMAT ADJUSTMENT DEVICE

BACKGROUND OF THE INVENTION

The present invention relates to a format adjustment device for adjusting the format of at least one functional element on a packaging machine.

In packaging technology products are often packed in cardboard containers. To this end, flat cardboard blanks are removed from a stack, supplied to a forming and folding apparatus and pressed by a forming tool by means of plungers and consequently they are formed into a cardboard container. The formed cartons are then supplied to a packaging system, filled and re-closed.

In order to be able to produce several different carton formats on the same machine, individual parts of the machine have to be adapted or adjusted to said different sizes. For example, the following modules of the machine have to be converted to the various carton formats: cardboard blank magazine, cardboard blank outlet, plungers, forming tool, positions of the glue nozzles in the case of hot glue variants, various blank supplying means and carton removal conveyors.

Known solutions realize the adjustment in different ways.

For example, it is known to exchange format-dependent parts such as the plunger and the forming tool. Said so-called interchangeable tools are adapted to the corresponding carton format. The advantage of said solution is that the tools are pre-adjusted and consequently a short ramp-up (start time) is achieved for the production; this means the machine is up and running again correctly with the new format and at maximum efficiency within a short time. No adjusting has to be done at the start of production.

A disadvantage is that above all in the case of many formats many replacement tools are needed, which is expensive and requires a lot of storage space. The replacement tools are often very heavy such that lifting tools have to be used sometimes for installation and removal.

It is also known that in the case of tools, e.g. forming tools, the lateral walls and corner elements are mounted on rails and are adjustable with spindles. The spindles can be operated by hand as well as by setting motors. Such adjustments are also made for lateral guides or for the carton magazine.

An advantage is that no expensive conversion work has to be carried out during a format change. The ramp-up time in the case of the variant with the setting motor is very short as the presetting, as a rule, is able to be stored. A disadvantage in the case of the motor-driven variant, however, is that it is very expensive as separate setting motors with actuating means have to be used for each dimension. The error susceptibility is also higher as more (electric) components are in use. The manually adjustable variant is certainly somewhat more cost-efficient but is more difficult to adjust. In this case, the adjustment has to be performed using graduations mounted on the adjustment element. In addition, the fine adjustment has to be made every time at the start of production, that is the ramp-up time becomes longer, which leads to impaired availability. In the case of multi-track variants, said adjustment has to be made on each track; there are therefore numerous spindles to adjust, which is cost-intensive and leads to a high degree of error susceptibility.

A further variant is the fastening of the individual elements of the forming tool to the rails by means of clamping screws. This is certainly also a cost-efficient variant, but has similar disadvantages of adjusting the spindle by hand.

SUMMARY OF THE INVENTION

Proceeding from said prior art, the object underlying the invention is to provide a format adjustment device for apparatuses for producing packaging with a different format or different size and form, said device overcoming the disadvantages of the prior art. In particular, the format adjustment device is to be simpler to handle, as well as cost-efficient and is to enable a short ramp-up time for production once the device has been converted to a new format.

Said object is achieved by a format adjustment device according to the invention. Accordingly, a format adjustment device serves for adjusting the format of at least one functional element on a packaging machine, in particular on a device for producing packaging of a different size and/or form. The format adjustment device includes at least one bearing element, at least one format gauge including at least one bearing portion and at least one position element with at least one stop portion, and at least one functional element with at least one connecting portion. The format gauge is connectable to the bearing element by means of the bearing portion. The stop portion of the position element is connectable to the connection portion of the functional element such that the position of the at least one functional element is adjustable with reference to the bearing element. The arrangement of a format gauge can create a device which can be handled in a simpler manner and as a result of which at the same time the required time for a format change can be reduced. Particularly advantageous is the fact that the functional elements are connectable to the position elements of the format gauge and are positionable as a result.

It is preferred for the bearing element to be arranged in a fixed manner with reference to the format adjustment device and/or to the packaging machine. The stop portion of the position element preferably projects into the connecting portion of the functional element, wherein the format gauge is realized separately from the functional element.

The format gauge is preferably in the form of a rod which extends along a center axis, or the format gauge is in the form of a frame. In addition, format gauges in the form of plates or disks, in particular round disks, are also conceivable.

The at least one format gauge is preferably realized so as to be exchangeable, preferably without any tools, as one unit with reference to the format adjustment device during a format change, wherein each format to be adjusted has allocated thereto a preferably dedicated, preferably single-use, format gauge, preferably a dedicated, preferably single-use set consisting of several format gauges. The functional elements preferably remain in the packaging machine during a format change and are correspondingly positioned by way of the format gauge to be newly inserted. As a result, a particularly simple and above all rapid format change can be achieved.

In a more preferred manner, different format gauges are present for different formats, as a result of which the format gauges are simply exchanged in the case of a format change. In a particularly preferred manner, a dedicated format gauge is allocated to each item of packaging to be produced. The advantage of this is that faulty adjustments during a format change can be reduced because one format has assigned thereto a corresponding format gauge. In a particularly preferred manner, a set of different format gauges is always exchanged. The format gauge is consequently an interchangeable or exchangeable element.

The at least one position element is preferably connected to the format gauge so as to be adjustable or settable or fixed. The term connected so as to be adjustable or settable refers to the fact that the position element is able to be adjusted manually with reference to the format gauge and that the position element can be fixed in at least two different positions with reference to the format gauge. In the case of the fixed connection, the position element is in a non-changeable position with reference to the format gauge.

The at least one position element is preferably connected to the format gauge by means of frictional connection or positive locking or positive bonding.

In the case of the positive locking connection, the format gauge can have means at defined positions, by way of which means the position elements can be moved into positive locking. Such means can be, for example, recesses, gear teeth, dowel pins and/or latching means. The connection can be realized as a latching connection and/or as a plug-in connection. Consequently, a position element can be adjusted, for example, to pre-defined positions.

In a particularly advantageous manner, the position of the position elements on the format gauge can be steplessly adjustable and fixed by a frictional connection. In particular, the position of the position elements can be fixed in a frictionally connected manner by means of a detachable clamping connection. As a rule, this is done at the first set-up of a format and the position can be finely adjusted in production. Said adjustments are maintained even in the case of a format change.

In the case of the positive bonding connection, the position of the position elements on the format gauge can be defined once either during production or at the first use and is then no longer changeable.

As an alternative to the types of connection, the at least one position element can be integral with the format gauge, that is realized from one piece, such as, for example, by means of production from a casting and/or by means of production using a single-component or multi-component injection molding method and in an advantageous manner from one single blank. An integral format gauge can be produced in a particularly cost-efficient manner.

A combination of the above types of connection between the position elements and the format gauge is also conceivable, e.g. individual position elements can be integrally realized with the format gauge, others can be realized in a positive locking manner by means of latching means, yet others can be realized by means of frictional locking. It is also conceivable for the position elements to be able to be adjusted using spindles, setting motors, cylinders or other means.

In a preferred manner the functional elements are mounted so as to be movable on a guide rail, wherein the guide rail is preferably part of the packaging machine, and the format gauge can preferably be arranged parallel to the guide rail, wherein in a preferred manner the bearing element is connected to the guide rail.

As an alternative to this, the functional element is directly connectable to the format gauge such that the functional element is essentially mounted by the format gauge.

A packaging machine includes at least one format adjustment device as claimed in the above description and at least one bearing element for accommodating the format adjustment device. A format change can be effected very simply in the case of such a packaging machine.

The packaging machine preferably additionally includes at least one forming tool for forming an item of packaging from a blank, wherein the forming tool includes at least one corner element and optionally at least one lateral element. The corner element and the lateral element in each case each include at least one functional portion and one connecting portion for accommodating the position element of the format gauge. The packaging is formable by means of the functional portion, it being possible for this purpose to use, for example, a forming plunger which can be part of the forming tool.

The packaging machine preferably additionally includes at least one adhesive nozzle, wherein the adhesive nozzle includes a connecting portion which is integrally formed in particular on a holder which is connected to the adhesive nozzle.

BRIEF DESCRIPTION OF THE DRAWINGS

Preferred embodiments of the invention are described below by way of the drawings, which purely serve to explain and are not provided in a restricting manner, in which.

DETAILED DESCRIPTION

Figure 1:
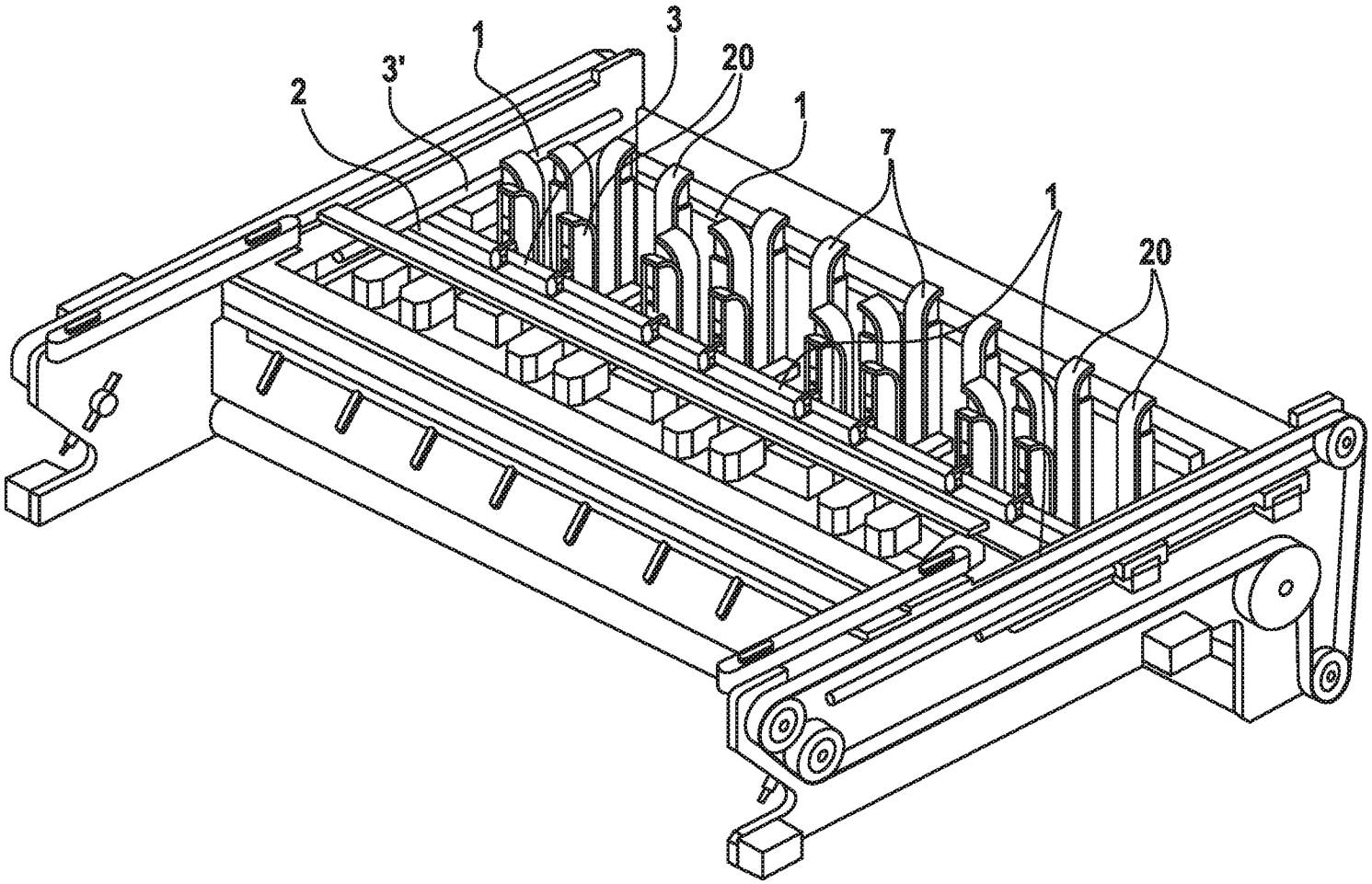
FIG. 1 shows a first embodiment of a format adjustment device as claimed in the present invention in conjunction with a forming tool.

FIG. 1 shows a format adjustment device 1 as claimed in the invention by way of a forming tool which will be explained later in more detail with reference to FIGS. 5 and 6. The forming tool serves in the present case for producing cardboard boxes for accommodating packaged or non-packaged objects. The forming tool will be explained in more detail below. Apparatuses which can produce packaging, in particular cardboard containers, of different sizes and forms are built and used as a rule. The term format is to refer in this context to a certain size and/or form of an item of packaging. In order to produce a different packaging with the apparatus, it can be necessary to convert it to a new format. In this case, different functions of the apparatus, such as the blank magazine, the puncher and the forming tool can be converted to the new dimensions, such as length, width, height and if need be also the form of the container.

The term packaging machine can refer to an apparatus for producing packaging of various sizes and forms.

Figure 2:
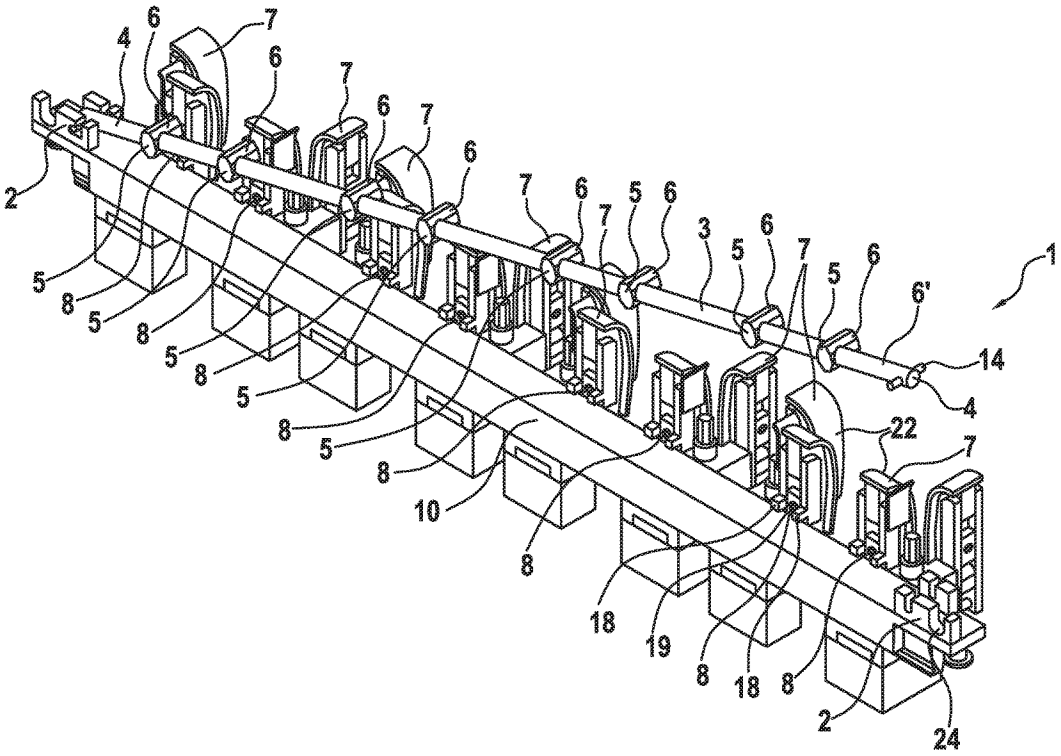
FIG. 2 shows a view of the detail of the format adjustment device as claimed in the present invention with elements from FIG. 1.

FIG. 2 shows a view of a detail of an embodiment of the format adjustment device 1 as claimed in the invention, said format adjustment device serving for adjusting the format of a functional element on a packaging machine. Said format adjustment device can be used, for example, in conjunction with the forming tool according to FIG. 1 or also, however, in other devices.

The format adjustment device 1 includes at least one bearing element 2, at least one format gauge 3 and at least one functional element 7 which is alignable with respect to the bearing element 2 by means of the format gauge 3. The format gauge 3, in this case, is connectable to the bearing element 2 and is connected to the at least one functional element 7 such that the functional element 7 is alignable with reference to the bearing element 2 or to the format gauge 3. The position of the at least one functional element 7 is consequently adjustable with reference to the bearing element 2. The format gauge 3 includes at least one bearing portion 4 and at least one position element 5 with at least one stop portion 6. The functional element 7 has at least one connecting portion 8 which is connectable to the stop portion 6. In other words, it can consequently be said that the format gauge 3 is connectable to the bearing element 2 by means of a bearing portion 4, and that the stop portion 6 is connectable to the connecting portion 8 of the functional element 7 such that the position of the at least one functional element 7 is adjustable with reference to the bearing element 2.

In the case of the positioning, the functional elements 7 are pre-positioned to the desired positions. The format gauge 3 is then connected to the bearing element 2 and the position elements 5 are connected to the functional elements 7, as a result of which the functional elements 7 are positioned precisely by the format gauge 3. In the case of a format change, the format gauge 3 can be replaced by another format gauge 3, as a result of which the format is automatically changed. A fine adjustment of the position elements 5 is not required, as a result of which the conversion time in the case of a format change can be reduced.

In the case of a first-time use of a format gauge 3, the corresponding format must be adjusted. In the case of a first-time set-up of a format, all the necessary format gauges 3 are provided with the true and the correct number of position elements 5, are inserted at the correct location in the machine and are moved into engagement with the functional elements 7. Then all the position elements 5 on the format gauges 3 are moved into position such that the corresponding functional elements 7 are positioned at the correct position for said format. When the format is moved in, the functional elements 7 are finely adjusted by the corresponding functional elements 5 being adjusted. This step is omitted in the case of the embodiment described below where the position elements 5 are arranged in a fixed manner. All the exchangeable format gauges 3 are then identified with the corresponding format and possible codings are provided. Said format gauges 3 can be stored as a format set and be used again in the next production of said format. In this case, it is also ensured that the last fine adjustment which has been made on the format gauges 3 is still set.

The at least one bearing element 2 is fixed with reference to the format adjustment device 1 or to the packaging machine in which the format adjustment device 1 is arranged. This means that the position of the bearing element 2 serves as reference point for the adjusting of the functional element 7. Therefore, in other words it can be said that the functional elements 7 are aligned or positioned with reference to the bearing element 2.

The format gauge 3 includes, as already mentioned above, at least one bearing portion 4 and at least one position element 5 with at least one stop portion 6. The bearing portion 4 serves for the connection to the bearing element 2. The position element 5 with the stop portion 6 serves for positioning the functional element 7. In a preferred manner, the number of position elements 5 corresponds to the number of functional elements 7. Two bearing portions 4 are arranged in this case.

The functional element 7 has at least one connecting portion 8. The connecting portion 8 is realized in a manner corresponding to the stop portion 6 and the functional element 7 can be positioned by means of the stop portion 6 and the connection portion 8. In addition, the functional element 7 can include at least one functional portion 22 which serves for the realization of a certain function.

Figure 3:
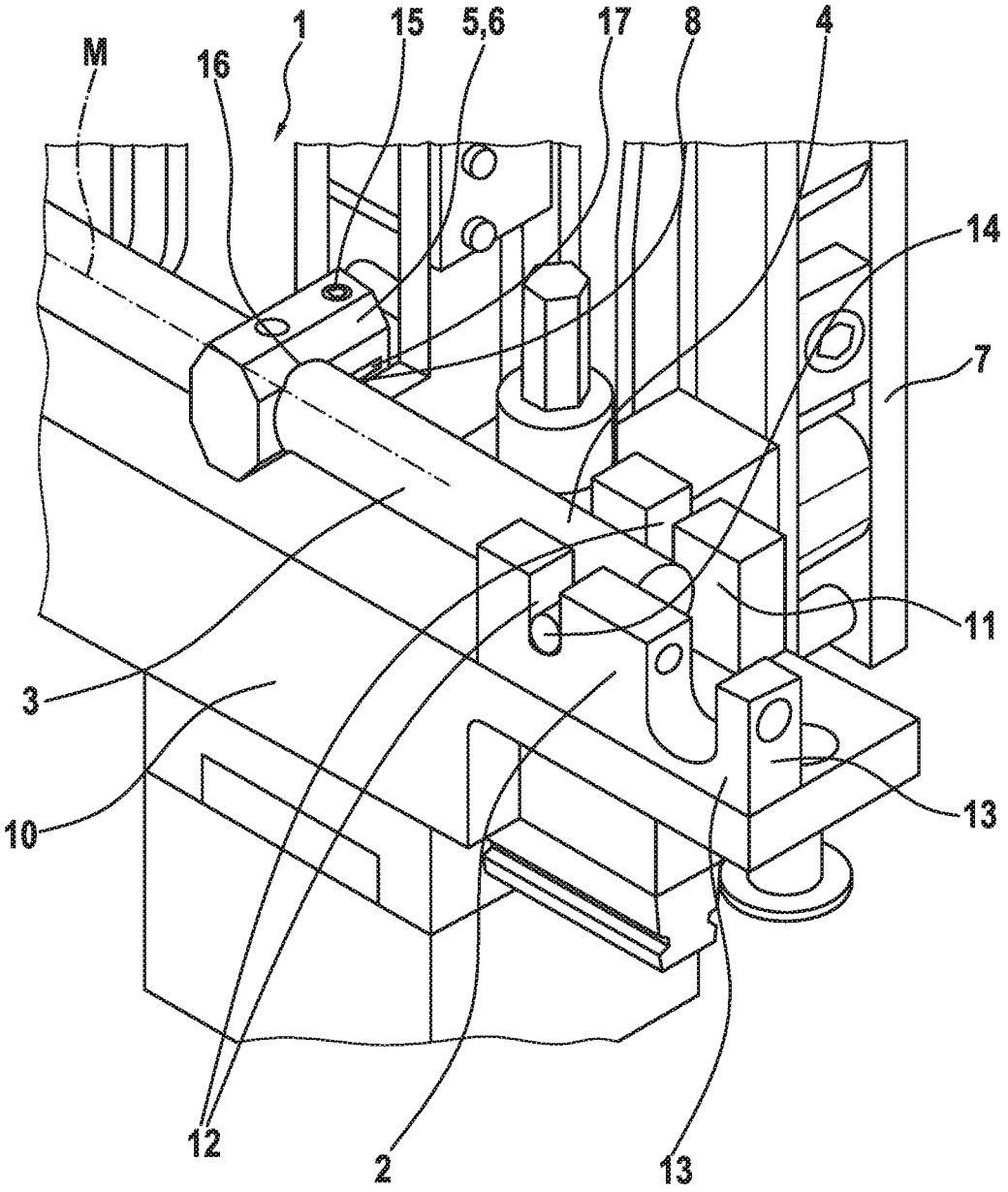
FIG. 3 shows a view of a detail of FIG. 2.
Figure 4:
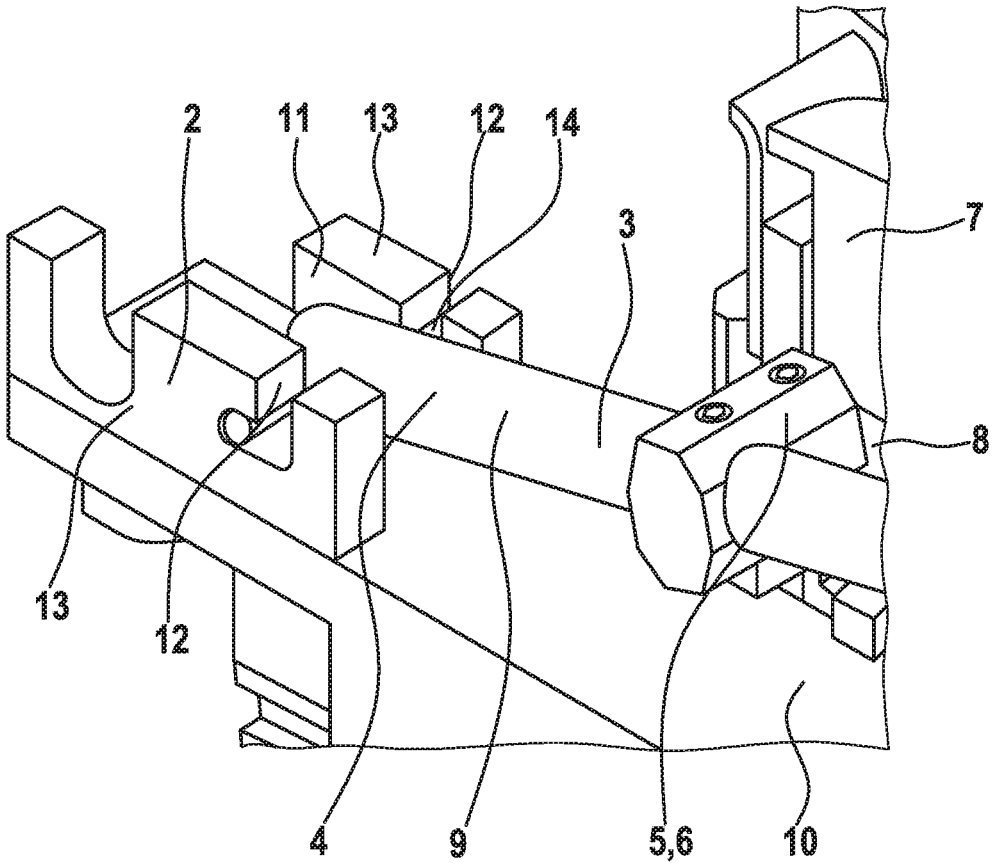
FIG. 4 shows a view of a detail of FIG. 2.

The bearing element 2, which can be seen easily in FIGS. 3 and 4, includes in the present embodiment a first accommodating space 11 for accommodating the format gauge 3 and a second accommodating space 12 for accommodating parts of the format gauge 3. In the present embodiment the two accommodating spaces 11, 12 are prepared by bearing blocks 13 which are arranged spaced apart from one another. The first accommodating space 11 is defined by the space between the two bearing blocks 13 and the second accommodating space is prepared by recesses in the bearing block 13.

The format gauge 3, in the present embodiment, is realized in a substantially bar-shaped manner and extends along a center axis M. The cross section of the bar can be different; in the present embodiment a round cross section is shown. As an alternative to this an angular or polygonal cross section would be conceivable. A journal 14 runs at right angles to the center axis M in the region of the bearing portion 4. Said journal 14 projects into the second accommodating space 12 in the state connected to the bearing element, whilst the rod 9 projects into the first accommodating space. The format gauge 3 is aligned in all 3 directions with reference to the bearing element 2 by means of the journal 14 and the rod 9 of the bearing portion 4.

Two bearing elements 2 are arranged in the present embodiment and the format gauge 3 also includes two bearing portions 4 which are arranged at the end of the corresponding rod 9.

The position elements 5 can be connected to the format gauge 3 in a fixed or adjustable manner. The term fixed refers to the fact that a user is not able to perform any adjustments to the position elements 5 because the position elements 5 are fixedly connected with reference to the format gauge 3. Consequently, one format gauge is provided for one fixed format. Said embodiment is advantageous particularly whenever a later fine adjustment should not be necessary.

In the case of the adjustable or positionable variant, the user can adjust the position of the position elements 5 with reference to the format gauge 3. The position of the position elements 5 can then be adjusted on the format gauge 3, a fine adjustment at a later time still being possible. In the case of said embodiment, tolerances and errors can be compensated for through the fine adjustment during production. The compensation can then be used again when the identical format gauge is used again, as a result of which the fine adjustments are automatically assumed.

In other words it can be said that the at least one position element 5 can be connected to the format gauge 3, therefore, by means of frictional locking or positive locking or positive bonding.

In the present embodiment, the position element 5 is clamped to the format gauge 3 by means of a screw connection 15. Consequently, it is an adjustable embodiment. The position element 5, in this case, has an opening 16, which corresponds to the cross section of the rod 9, and a slot 17 which extends from the opening 16. The screw connection 15, in this case, extends through the slot 17, the slot 17 and also the opening 16 being reduced in size when the screw connection 15 is tightened such that the position element 5 is clamped to the format gauge 3 or to the rod 9. The position element 5 is preferably secured additionally to the format gauge 3 by means of a pin connection or by means of applying a varnish.

In the case of the positive bonding connection, the position element 5 is fixedly connected, for example by means of a weld connection, to the format gauge 3.

As an alternative to this, it would also be conceivable for the format gauge 3 to have corresponding portions which allow for a positive locking connection to the position element 5.

In a further alternative embodiment, the format gauge 3 can also be realized integrally with the position element 5. This would be particularly advantageous, for example, if the format gauge 3 and the position element 5 consisted of a stamping. As an alternative to this, the format gauge could also be a corresponding rotary part with radially extending punctures.

The advantage of the positioning of the position elements on the format gauge 3 is that different format gauges 3 can be prepared for pre-defined formats. In the case of a format change on the packaging machine, where required the user then simply has to choose a different format gauge 3 and can adjust the functional elements in a corresponding manner by way of said format gauge 3. Consequently, a costly fine adjustment of the functional elements 7 is omitted. It can be mentioned in this context that a certain format gauge can be used for several formats if the adjustments of the corresponding format gauge are the same for the different formats.

The stop portion 6 of the position element 5 projects, in this case, into the connecting portion 8 of the functional element 7. For this purpose, the connecting portion 8 has two cams 18 which provide a recess 19 for the accommodation of the stop portion 6. It would also be conceivable for the stop portion 6 of the position element 5 to be realized as a recess and the connecting portion 8 as an element which fits into the recess.

In a further development, a format gauge 3 has position elements 5 which are realized differently from one another. Correspondingly, the connecting portions 8 are also realized differently from one another such that the position elements 5 are only movable into engagement with a certain connecting portion 8, such that a format gauge 3 is able to be used for the adjusting of different formats. The position elements 5 and the connecting portions 8 are preferably realized in each case such that only one certain format can be adjusted, a corresponding position element 5 being able to project into a connecting portion 8 which is assigned to the position element 5, as a result of which once again a coding is achievable. The engagement of the stop portion 6 in the connecting portion 8 is preferably coded such that it is ensured that the connecting portions 8 of the functional elements 7 engage with the correct stop portions 6 or that no confusion or mix-up occurs in the case of the different formats or that there is no confusion between position elements and connecting portions of a certain format gauge 3 of a certain format. The coding can also be realized by a visually perceivable identification, such as the embossing of numbers, letters or the provision of a color.

In addition, the bearing portion 4 can also be coded. As a result, it can be ensured that the format gauge 3 is insertable only in a pre-defined position into the bearing elements 2 and/or into the correct bearing element 2. Consequently, the format gauge 3 can be prevented from being inserted the wrong way round or at the wrong location. In other words it can be said that when the gauge is realized as a rod, for example, with the suitable coding said gauge can be prevented from being inserted the wrong way round. Or when there are several identically formed format gauges per machine, this can prevent a format gauge from being inserted at the wrong location and consequently a wrong format adjustment from being made. The coding can, for example, be provided by a different realization of the bearing portion 4. For example, by selecting different diameters for the journal 14 and the second accommodating space 12 and/or by selecting a different dimension for the bearing portion 4 of the format gauge 3 itself and for the first accommodating space 11. The coding can also be realized by means of a visually perceivable identification such as the embossing of numbers, letters or the provision of a color.

The at least one functional element 7 is preferably connected to a guide rail 10 and is movable with reference to said guide rail 10. The guide rail 10, in this case, can be part of the packaging machine or also part of a functional element. The bearing element 2 is preferably fixedly connected to the guide rail 10.

In an alternative embodiment, the functional element 7 can also be suspended directly from the format gauge 3 such that the functional element 7 is essentially mounted by the format gauge 3.

The format gauge 3 can be realized in a different manner depending on the application. For example, as a rail, plate or disk. In the case of a disk, a circular disk, which has on its circumference various vertically adjustable bars which can serve as stops, is selected in a preferred manner. In the case of said variant, the format gauge is not exchanged but rotated such that the rod which corresponds to a certain format moves to the position at which it is able to engage with its associated element.

Figure 5:
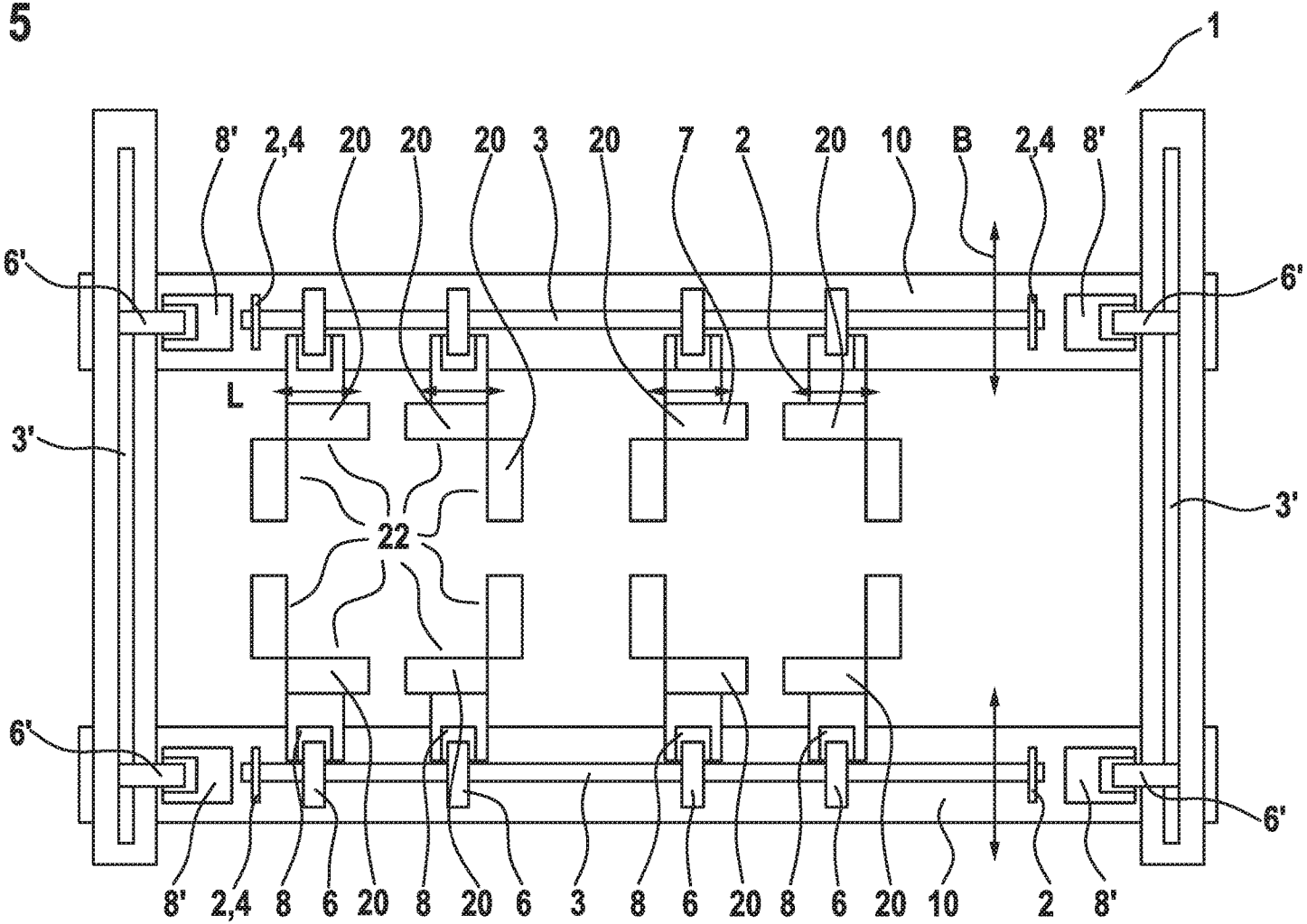
FIG. 5 shows a schematic view of a forming tool in a first configuration.
Figure 6:
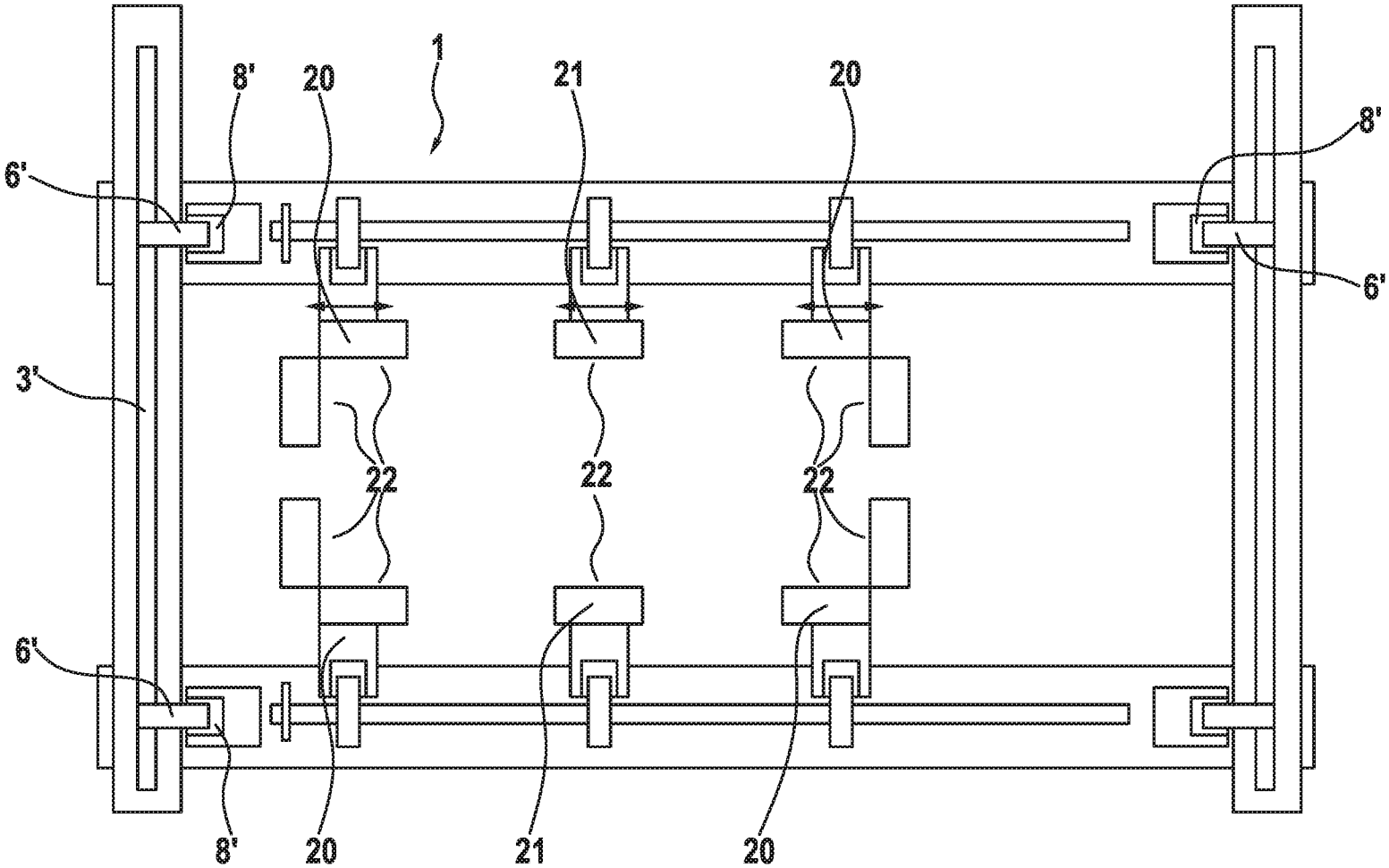
FIG. 6 shows a schematic view of the forming tool according to FIG. 5 in a further configuration.

FIGS. 5 and 6 show a schematic representation of the application of the format adjustment device as claimed in the invention in conjunction with a forming tool for producing a container from a flat blank. In principle, the parts have the identical references as claimed in the above description.

The functional element 7, in this case, is in the form of form elements, here corner elements 20 and lateral elements 21. The form elements 20, 21 include a connecting portion 8 and a functional portion 22. The connecting portion 8 is connected to the stop portion 6 of the position element 5 and the functional portion 22 serves for forming the container.

The two corner elements 20 are mounted so as to be displaceable on a first common guide rail 10 on the one side of the container to be formed, the two other corner elements of the second side of the container to be formed are mounted on a second guide rail 10. Using a format gauge 3 which is associated with the first guide rail 10 and first corner elements, said first two corner elements are positioned at the corresponding position by the connecting portion 8, in this case the groove of each corner element 20, moving to engage with the corresponding stop portion 6, in this case the cam, of the format gauge 3. In an analogous manner, the two other corner elements 20 engage with a second format gauge 3. Consequently, the form has been adjusted to the correct size with reference to the first direction L.

In order to adjust the width of the form to the correct size, the two guide rails 10, which carry and guide the corner elements 20, are also mounted so as to be displaceable. They are, however, displaceable at right angles to the direction of displacement L of the corner elements along the direction B. In order to fix the guide rails 10 at the correct position, the guide rails 10 are provided with a connecting portion 8', in this case a groove, which engages with a stop portion 6', in this case a cam of a further format gauge 3'. The guide rails 10 each engage with a format gauge 3' on both sides, one side each of both guide rails 10 engaging with the same further format gauge 3'. In this case, the guide rail 10, which, in its turn, includes the corner elements 20 with the associated format gauges, is the functional element 7 and the further format gauge 3', which can be attached in the machine housing, is the associated format gauge 3. Consequently, four format gauges 3, 3' are necessary for adjusting the form.

As an alternative to this, said four format gauges can also be realized as a rectangular frame which includes all the stop portions 6 of the individual format gauges 3, 3'.

In the example shown in FIG. 1, four cartons are formed side by side. This means that it is not only the two corner elements 20 of the one form that are mounted on the guide rails 10, but a total of eight corner elements, two each per form. The corner elements 20 can be removed and re-attached depending on how many containers are to be formed in parallel. FIG. 5 shows this with two corner elements 20 which are arranged side by side.

It must also be noted that it is not only containers with rectangular outlines that are able to be processed. Other forms, such as, for example, octagonal, rounded and further forms are also conceivable. However, functional elements which are adapted to the forms must be used for this purpose.

It is possible to use lateral elements 21 also in addition to the corner elements 20 for larger containers so that better stability of the container can be achieved during the forming process. This is shown in FIG. 6. A possible coding in this case can appear such that in each case the corner elements 20 on the left are provided with larger cams and the corner elements 20 on the right are provided with smaller cams. In order to prevent it being possible to insert the format gauges 3 the wrong way round or in a confused manner, a suitable coding can also be used with said format gauges. The format gauges 3 can be provided with bearing bolts 14 of a different length or diameter at their individual ends, or different realizations of cam and groove, such as an end face groove or ring-shaped cam, or rather a bond can be used. As an alternative to this or in addition to it, the format gauges 3 can have different lengths or diameters. Further types of coding are mentioned above and can be used here equally.

Figure 7:
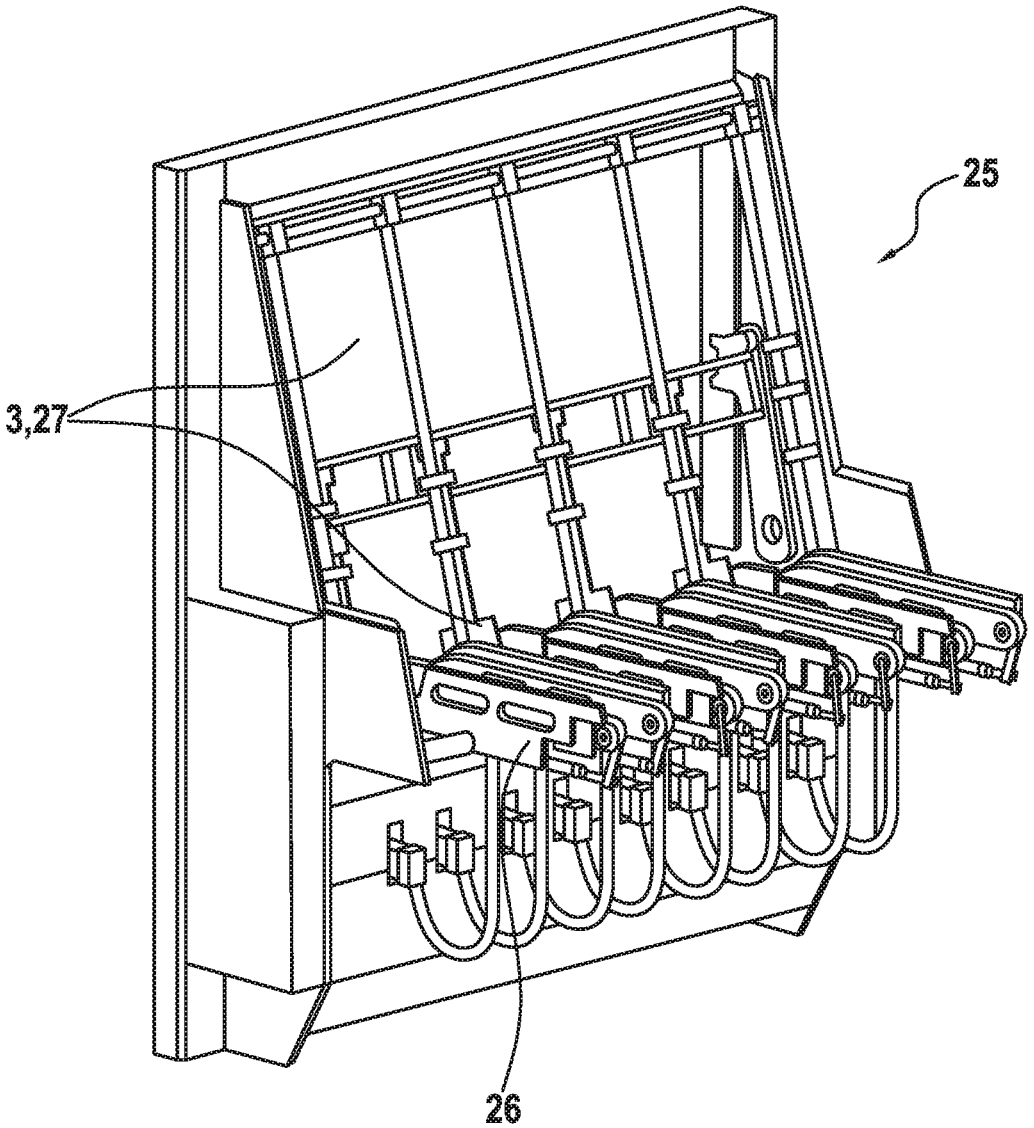
FIG. 7 shows a schematic view of a carton magazine with a format adjustment device as claimed in the present invention.
Figure 7A:
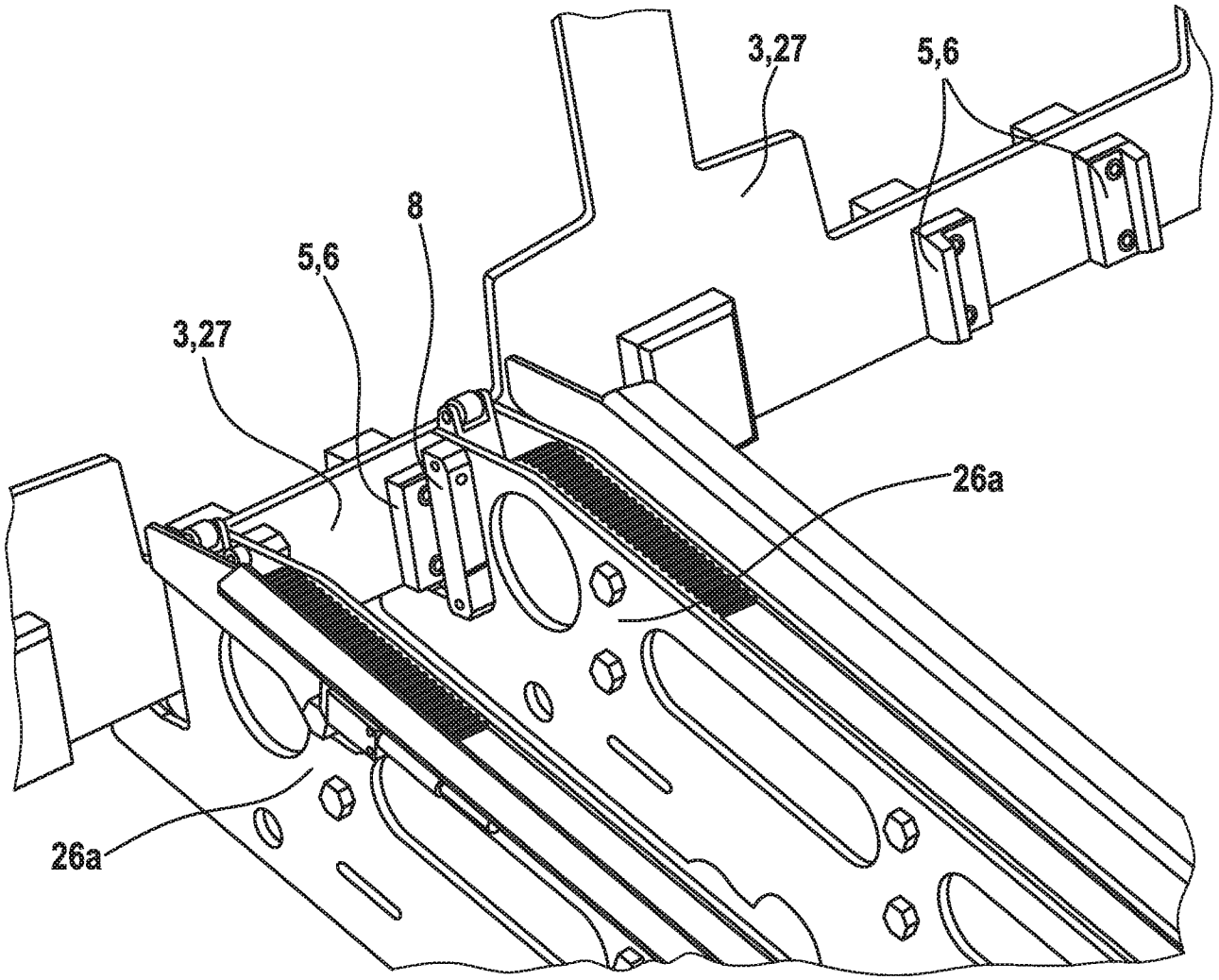
FIG. 7*a* shows a view of a detail of FIG. 7.

FIG. 7 shows a further embodiment of the format adjustment device 1. In this case, the format adjustment device 1 is shown in conjunction with a carton magazine. A carton magazine 25 has to be adapted to the size of the carton blank. A carton blank, which can be supplied, for example, to the forming tool shown above, is removed from said carton magazine.

In the majority of cases, such magazines also have a pre-conveying means 26, which is arranged below the blank stack. The pre-conveying means consists of two circulating belts which are each attached to a carrier **26*a*. The two carriers 26*a* have to be positioned laterally corresponding to the size of the blanks. In this case each of the two carriers 26*a* is an element, said elements being provided with connecting portions 8. The format gauge 3, in this case, is a cover 27 which is arranged at the machine-side end of the magazine 25 and serves at the same time as a safety cover. The corresponding position elements 5 are now screw-connected to the disk at the correct position. Said disk is exchanged where required as a format gauge 3**.

Figure 8:
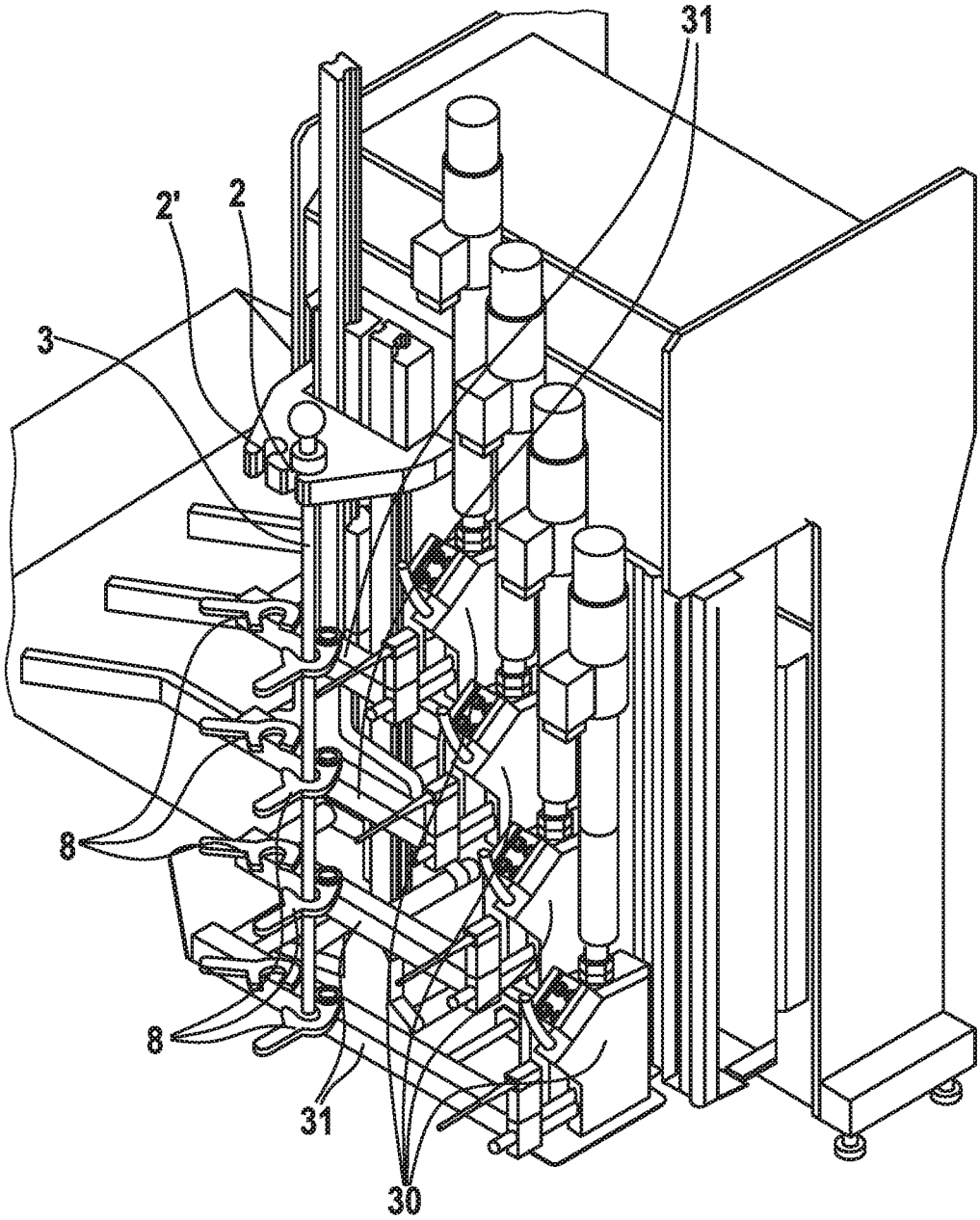
FIGS. 8 and 9 show a schematic view of a glue apparatus with a format adjustment device as claimed in the present invention.
Figure 9:
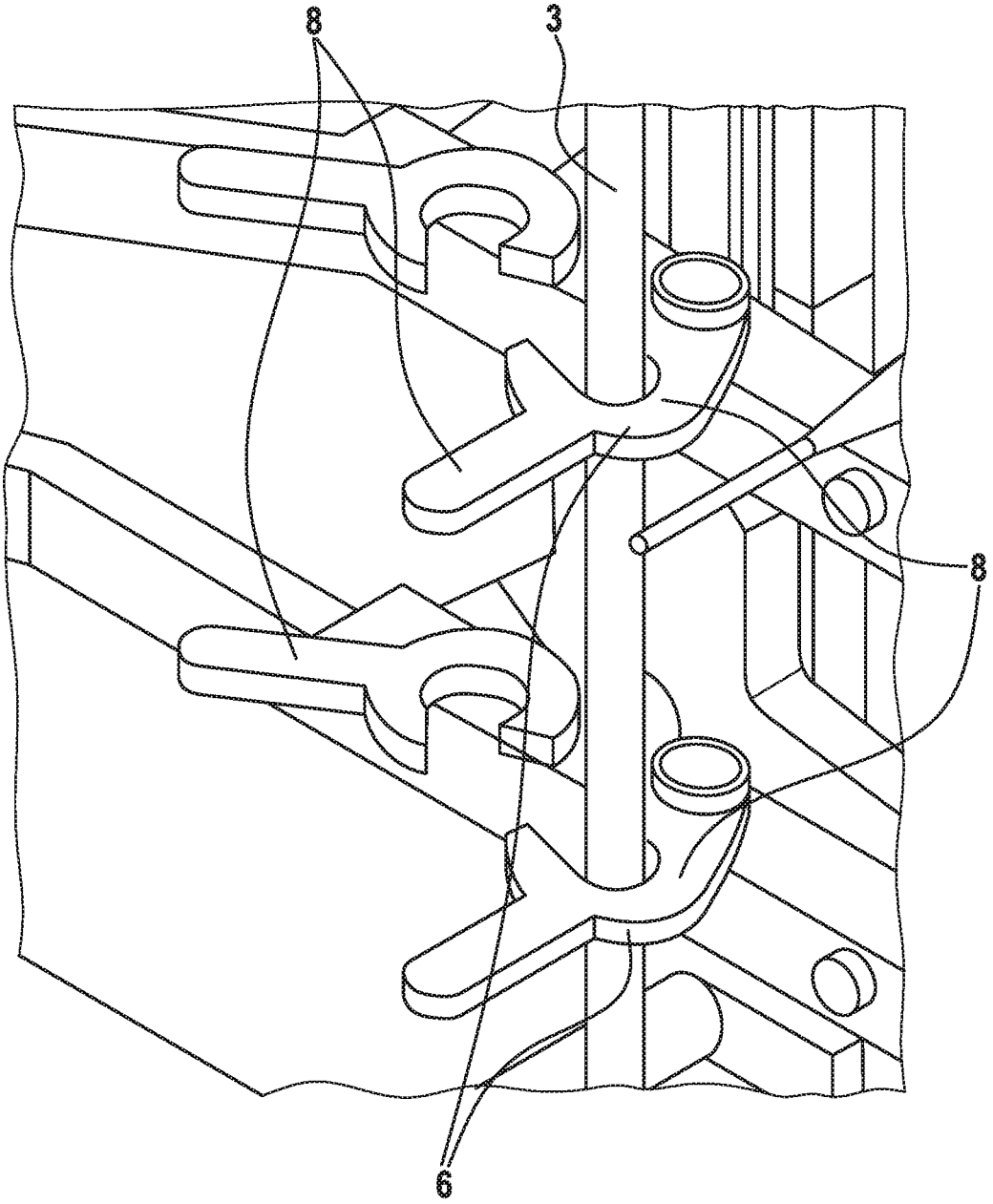

FIGS. 8 and 9 show a schematic representation of the application of the format adjustment device as claimed in the invention in conjunction with an adhesive-applying tool for bonding the sides of a container made from a flat blank. The parts have, in principle, the identical references as claimed in the above description. Such a device can be used, for example, in order to bond elements formed by the forming tool. The adhesive nozzles 30 for injecting the hot glue must also be positioned correctly for this purpose. The glue nozzles 30 are each mounted individually on a holder 31. Said holder 31 is mounted so as to be displaceable and has a connecting portion 8 which engages with a corresponding stop portion 6 of the vertically mounted format gauge 3. The format gauge 3 is inserted and the individual holders 31 are displaced vertically such that they engage by way of their corresponding stop portion 6. The connecting element 8 is pushed from above onto the stop element 6 and suspended such that the holder 31 is fixed.

As the glue nozzle holders 31 are attached so as to be vertically displaceable, the holders 31 would fall downward through gravity when the format gauges 3 are exchanged. This can be prevented by the following special design. Each element/holder has two connecting portions 8. When the format is changed, the new format rod is inserted in a second bearing element 2'. The holders of all the glue nozzles are then moved from the groove elements of the first, former format rod to the groove elements of the second, new format rod. Finally, the former format rod is removed.

Figure 10:
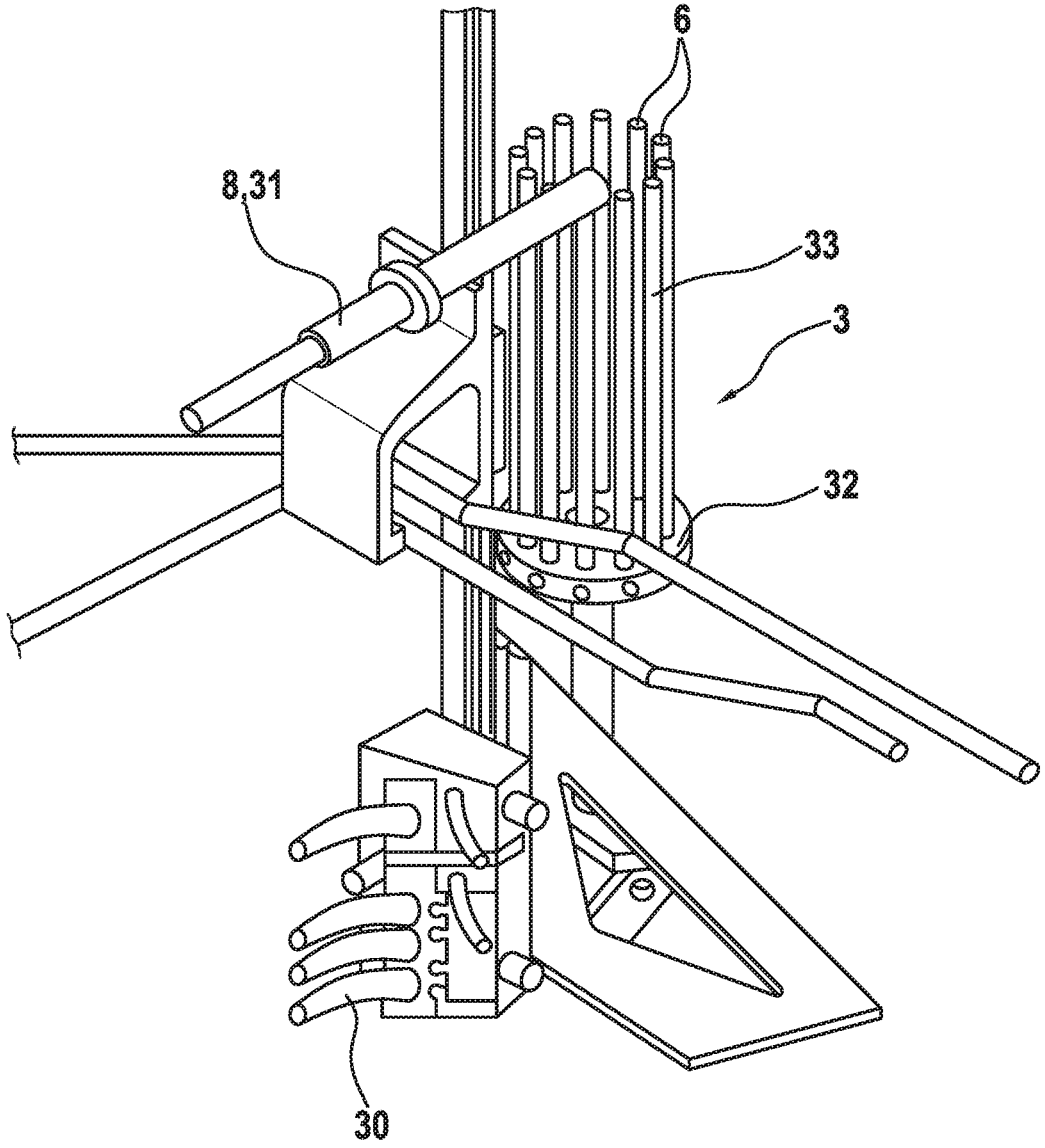
FIG. 10 shows a further application of a format adjustment device.

As an alternative to this, which is shown in FIG. 10, the holders 31 of the glue nozzles 30, which are mounted so as to be vertically displaceable, can contact a stop 6 of the format gauge 3. Vertically adjustable rods 33 are mounted per format on the circumference of a circular disk 32. Said rods 33 serve as stops for the glue nozzle holders 31 and are adjusted to the correct height per format. During the format change, the format gauge 3 is not exchanged but rotated into the correct position.

Figure 11:
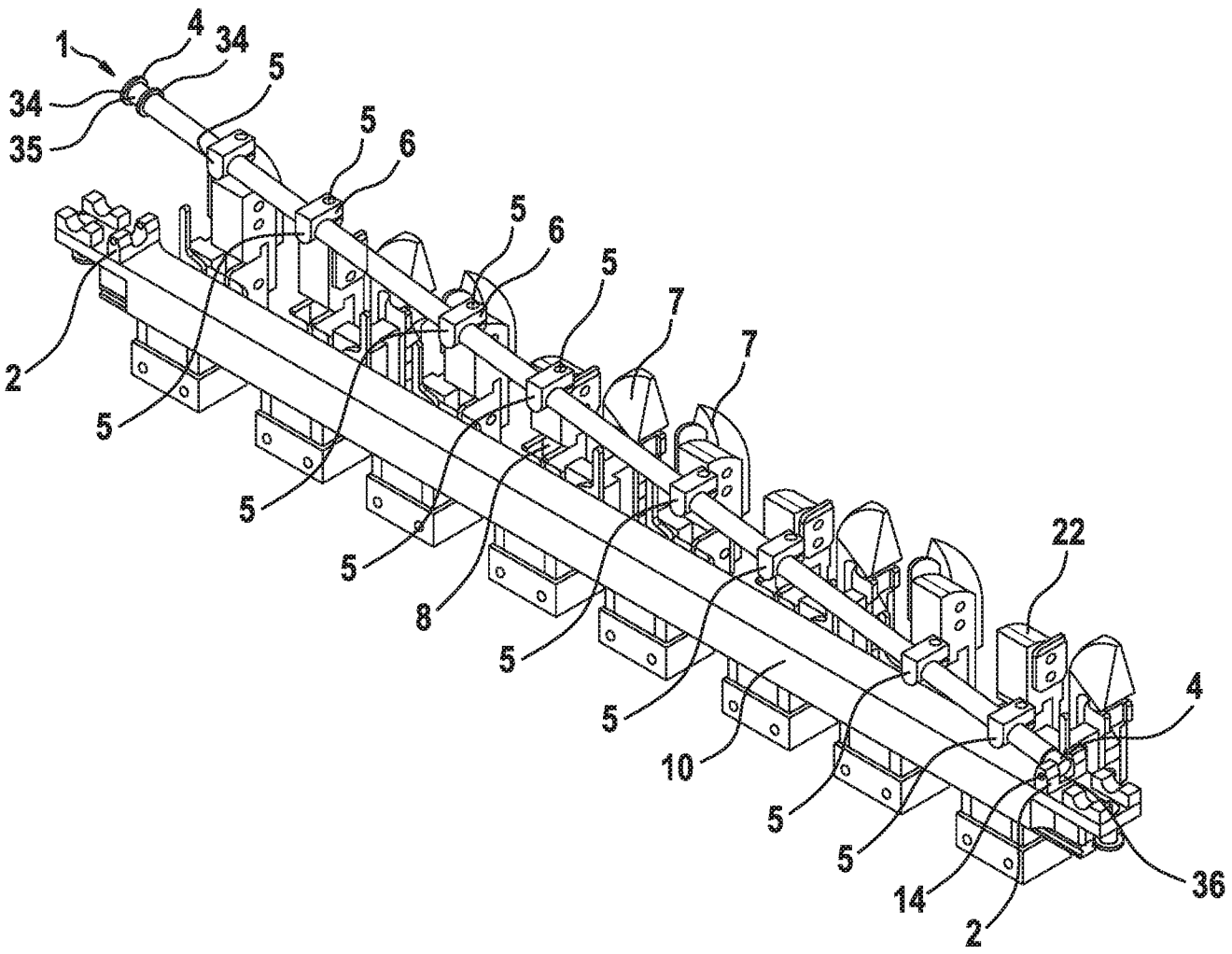
FIG. 11 shows a further embodiment of a format adjustment device.

FIG. 11 shows a further alternative embodiment of the format adjustment device 1. Identical parts, in this case, are provided with identical references. In principle, the format adjustment device 1 according to FIG. 11 is essentially identical to that according to FIG. 2. The bearing portion 4 is on the right and a groove 36 is provided at the front face of the rod 9. The bearing portion 4 on the right is connected to a bearing portion 2, the groove 36 engaging with or connecting to a journal 14 mounted on the bearing portion 2. The bearing portion 4 on the left is realized differently to the bearing portion of the format gauge according to FIG. 2. In this case, the bearing portion 4 on the left includes two elevations 34 which extend circulating around the rod 9 and form a channel 35. The rod 9 contacts the bearing portion 4 by way of said two elevations 34. As a result, position elements can be added to or removed from the format gauge 3 subsequently in a simple manner by pushing them on or off.

In summary it can be said that the format adjustment device has the following advantages:

simple, cost-efficient possibility for adjustment finely adjusted format gauges can be created per format, consequently the ramp-up time during a change to a new format is minimal re-adjusting during the normal production of a format is possible at all times no large, expensive format parts are necessary. The format gauges can be realized in a very cost-efficient manner and can be small there is a large amount of flexibility, no restriction to a fixed number of format elements. The number of elements per format can be different.

The invention claimed is:

1. A format adjustment device (1) for adjusting a format of at least one functional element (7) on a packaging machine, wherein the format adjustment device (1) includes at least one bearing element (2), at least one format gauge (3) including at least one bearing portion (4) and at least one position element (5) with at least one stop portion (6), and the at least one functional element (7) with at least one connecting portion (8), wherein the format gauge (3) is connectable to the bearing element (2) by means of the bearing portion (4), and wherein the stop portion (6) of the position element (5) is connectable to the connection portion (8) of the functional element (7) such that a position of the at least one functional element (7) is adjustable with reference to the bearing element (2); characterized in that the at least one format gauge (3) is realized so as to be exchangeable as one unit with reference to the format adjustment device (1) during a format change, wherein each format to be adjusted has allocated thereto a format gauge (3) or set consisting of several format gauges (3), and in that the functional elements (7) remain in the packaging machine during a format change, wherein the functional elements (7) are positionable by a newly insertable format gauge (3).

2. The format adjustment device as claimed in claim 1, characterized in that the bearing element (2) is arranged in a fixed manner with reference to at least one of the format adjustment device (1) and the packaging machine (10).

3. The format adjustment device as claimed in claim 1, characterized in that the format gauge (3) is in the form of a rod (9) which extends along a center axis (M).

4. The format adjustment device as claimed in claim 1, characterized in that the at least one position element (5) is connected to the format gauge (3), wherein the at least one position element (5) is realized so as to be adjustable or settable with reference to the format gauge (3).

5. The format adjustment device as claimed in claim 1, characterized in that the at least one position element (5) is connected to the format gauge (3) by means of frictional connection or positive locking or positive bonding.

6. The format adjustment device as claimed in claim 1, characterized in that the functional elements (7) are mounted so as to be movable on a guide rail (10).

7. The format adjustment device as claimed in claim 1, characterized in that the functional element (7) is directly connectable to the format gauge (3) such that the functional element (7) is essentially mounted by the format gauge (3).

8. The format adjustment device as claimed in claim 1, characterized in that the position of the format gauge (3) of the format adjustment device is adjustable by a further format gauge (3').

9. The format adjustment device as claimed in claim 1, characterized in that the connection between at least one of the stop portion (6) and the connecting portion (8) and the bearing portion (4) and the bearing element (2) is realized such that corresponding elements or portions are connectable exclusively in a pre-determined position.

10. The format adjustment device as claimed in claim 1, characterized in that the functional element (7) is a separate part from the format gauge (3) or the position element (5).

11. The format adjustment device as claimed in claim 1, characterized in that the functional element (7) is a forming tool for the forming of an item of packaging, or in that the functional element (7) is an adhesive nozzle, or in that the functional element (7) is a magazine (25) for accommodating blanks, or in that the functional element (7) is part of a magazine (25) for accommodating blanks.

12. The format adjustment device as claimed in claim 1, characterized in that one of the stop portion (6) of the position element and the connecting portion (8) of the functional element (7) is in the form of a groove and the other of the stop portion (6) of the position element and the connecting portion (8) of the functional element (7) is in the form of a cam which corresponds to the groove.

13. The format adjustment device as claimed in claim 1, characterized in that the stop portion (6) of the position element (5) projects into the connecting portion (8) of the functional element (7), wherein the format gauge (3) is realized separately from the functional element (7).

14. The format adjustment device as claimed in claim 13, characterized in that the bearing element (2) is arranged in a fixed manner with reference to at least one of the format adjustment device (1) and the packaging machine (10).

15. The format adjustment device as claimed in claim 1, characterized in that the at least one format gauge (3) is realized so as to be exchangeable, without any tools, as one unit with reference to the format adjustment device (1) during a format change, wherein each format to be adjusted has allocated thereto a dedicated, single-use, format gauge (3) or a dedicated, single-use, set consisting of several format gauges (3), and in that the functional elements (7) remain in the packaging machine during a format change, wherein the functional elements (7) are positionable by a newly insertable format gauge (3).

16. The format adjustment device as claimed in claim 1, characterized in that the format gauge (3) is in the form of a frame.

17. The format adjustment device as claimed in claim 1, characterized in that the at least one position element (5) is connected to the format gauge (3), wherein the at least one position element (5) is fixedly connected to the format gauge (3).

18. The format adjustment device as claimed in claim 1, characterized in that the at least one position element (5) is realized integrally with the format gauge (3).

19. The format adjustment device as claimed in claim 1, characterized in that the at least one position element (5) is connected to the format gauge (3) by means of a detachable clamping connection such that the position element (5) is adjustable with reference to the format gauge (3).

20. The format adjustment device as claimed in claim 1, characterized in that the functional elements (7) are mounted so as to be movable on a guide rail (10), wherein the guide rail (10) is part of the packaging machine, and in that the format gauge (3) is arranged parallel to the guide rail (10), wherein the bearing element (2) is connected to the guide rail (10).

21. The format adjustment device as claimed in claim 1, characterized in that the bearing portion (4) of the format gauge (3) has a format-adjusting function, wherein the bearing portion (4) includes corresponding connecting portions (8).

22. A packaging machine including at least one format adjustment device (1) as claimed in claim 1 and wherein the format adjustment device (1) includes the at least one bearing element (2) for accommodating the format adjustment device (1).

23. The packaging machine as claimed in claim 22, characterized in that the packaging machine additionally includes at least one forming tool (20, 21) for forming an item of packaging from a blank, wherein the forming tool includes at least one corner element (20), wherein the corner element (20) includes at least one functional portion (22) and one connecting portion (8) for accommodating the position element (5) of the format gauge (3), wherein the packaging is formable by means of the functional portion (22).

24. The packaging machine as claimed in claim 22, characterized in that the packaging machine additionally includes at least one adhesive nozzle (30), wherein the adhesive nozzle (30) includes a connecting portion (8) which is integrally formed on a holder (31) which is connected to the adhesive nozzle (30).

* * * * *